US008109012B2

(12) United States Patent
Sarantakos et al.

(10) Patent No.: US 8,109,012 B2
(45) Date of Patent: Feb. 7, 2012

(54) ARTICLE OF FOOTWEAR WITH DRAINAGE FEATURES

(75) Inventors: Michael G. Sarantakos, Portland, OR (US); Thomas Simshaw, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 675 days.

(21) Appl. No.: 12/248,798

(22) Filed: Oct. 9, 2008

(65) Prior Publication Data

US 2010/0088928 A1 Apr. 15, 2010

(51) Int. Cl.
*A43B 3/12* (2006.01)

(52) U.S. Cl. ..... 36/11.5; 36/8.1

(58) Field of Classification Search ..... 36/11.5, 36/8.1

See application file for complete search history.

(56) References Cited

U.S. PATENT DOCUMENTS

| | | | | | |
|---|---|---|---|---|---|
| 363,377 | A | * | 5/1887 | Faye, Jr. | 36/3 R |
| 1,433,309 | A | * | 10/1922 | Stimpson | 36/8.1 |
| 1,724,450 | A | * | 8/1929 | Callahan | 36/3 A |
| 2,075,229 | A | * | 3/1937 | Rose | 36/62 |
| 2,185,762 | A | * | 1/1940 | Cox | 36/8.1 |
| 2,692,401 | A | | 10/1954 | Stritter | |
| 2,734,286 | A | * | 2/1956 | Anson | 36/141 |
| 2,926,435 | A | * | 3/1960 | Maling | 36/58.5 |
| 3,160,963 | A | * | 12/1964 | Aaskov | 36/11.5 |
| 3,595,244 | A | * | 7/1971 | Kugler | 36/141 |
| 3,722,113 | A | | 3/1973 | Birkenstock | |
| 4,075,772 | A | * | 2/1978 | Sicurella | 36/43 |
| 4,268,980 | A | | 5/1981 | Gudas | |
| D270,964 | S | | 10/1983 | Archibald | |
| D275,145 | S | | 8/1984 | Glatz | |
| 4,525,940 | A | * | 7/1985 | Mochizuki | 36/8.1 |
| 4,570,362 | A | | 2/1986 | Vermonet | |
| 4,598,484 | A | | 7/1986 | Ma | |
| 4,617,745 | A | | 10/1986 | Batra | |
| D290,900 | S | | 7/1987 | Schornstein et al. | |
| 4,747,219 | A | * | 5/1988 | Ammendolea | 36/28 |
| 4,910,882 | A | | 3/1990 | Goller | |
| 4,910,887 | A | | 3/1990 | Turner et al. | |
| 4,939,851 | A | * | 7/1990 | Miller | 36/3 B |
| 4,972,610 | A | * | 11/1990 | Tong | 36/7.1 R |
| 5,014,448 | A | * | 5/1991 | Perrone | 36/110 |
| 5,165,183 | A | * | 11/1992 | Huang | 36/11.5 |
| 5,322,056 | A | * | 6/1994 | Menghi et al. | 601/136 |
| 5,400,526 | A | | 3/1995 | Sessa | |
| 5,839,208 | A | | 11/1998 | Huang | |
| 6,003,246 | A | * | 12/1999 | Pan | 36/11.5 |
| 6,014,821 | A | * | 1/2000 | Yaw | 36/8.1 |
| 6,701,640 | B2 | * | 3/2004 | Nakano | 36/8.1 |
| 6,871,420 | B2 | * | 3/2005 | Shikhashvili | 36/8.1 |
| 6,874,252 | B2 | * | 4/2005 | Nakano | 36/8.1 |

(Continued)

FOREIGN PATENT DOCUMENTS

| | | |
|---|---|---|
| JP | 2001-137002 | 5/2001 |

*Primary Examiner* — Darnell Jayne
*Assistant Examiner* — Andrew Roersma
(74) *Attorney, Agent, or Firm* — Plumsea Law Group, LLC

(57) ABSTRACT

An article of footwear configured to drain water away from a foot wearing the article of footwear includes a plurality of drainage holes positioned between ribs formed on the sole. The drainage holes are formed along a centerline of the sole. The drainage holes are substantially vertical channels formed entirely through the sole. The ribs include raised center portions disposed at or near the inlets to the drainage holes to lift the foot away from the drainage holes.

20 Claims, 14 Drawing Sheets

U.S. PATENT DOCUMENTS

| | | | | |
|---|---|---|---|---|
| D505,537 | S | 5/2005 | Friedman | |
| 6,898,871 | B2 * | 5/2005 | Herman | 36/28 |
| 7,055,265 | B1 | 6/2006 | Bathum et al. | |
| D532,190 | S | 11/2006 | Scheurer | |
| 7,310,894 | B1 | 12/2007 | Schwarzman et al. | |
| 7,367,142 | B2 * | 5/2008 | Ferniani et al. | 36/11.5 |
| D577,882 | S | 10/2008 | Little | |
| D606,292 | S | 12/2009 | Ong | |
| 7,703,219 | B2 | 4/2010 | Beck | |
| 7,762,008 | B1 * | 7/2010 | Clark et al. | 36/3 B |
| 2001/0025432 | A1 * | 10/2001 | Contreras et al. | 36/3 R |
| 2002/0088140 | A1 * | 7/2002 | Wang et al. | 36/3 B |
| 2003/0136023 | A1 | 7/2003 | Chen | |
| 2005/0120587 | A1 | 6/2005 | Helton et al. | |
| 2005/0217141 | A1 | 10/2005 | Cobian | |
| 2005/0262726 | A1 | 12/2005 | Ferniani et al. | |
| 2007/0240333 | A1 * | 10/2007 | Le et al. | 36/30 R |
| 2007/0245592 | A1 * | 10/2007 | Yamaguchi et al. | 36/11.5 |
| 2008/0052966 | A1 | 3/2008 | Pan | |
| 2010/0088928 | A1 | 4/2010 | Sarantakos et al. | |

* cited by examiner

ARTICLE OF FOOTWEAR WITH DRAINAGE FEATURES

BACKGROUND OF THE INVENTION

1. Field of the Invention

The present invention relates generally to an article of footwear having drainage capabilities, and more particularly to an article of footwear configured with drainage holes so that water cannot accumulate in the article of footwear, such as when showering.

2. Description of Related Art

Increasingly, people wear articles of footwear in or near water to protect their feet. For example, some people wear articles of footwear at the beach or in rivers and streams so that their feet are protected from cuts and abrasions from rocks or other environmental hazards. Similarly, some people wear articles of footwear in public showers so that their feet are protected from biological hazards, such as fungus.

While articles of footwear may protect the foot from contact with undesirable surfaces, these articles of footwear may accumulate water inside the article of footwear, which can be uncomfortable. Additionally, prolonged exposure to standing water may weaken the skin of the foot, allowing bacteria, fungus, or molds to attach to the skin or even break through the skin and cause an infection or other growth on the foot.

Articles of footwear for use in or around water have, therefore, been provided with drainage capabilities. For example U.S. patent application publication number 2002/0088140 to Wang et al. discloses a sole for footwear that is configured to drain water away from the wearer's foot. The sole includes a plurality of protrusions extending from a top surface of the sole and a plurality of apertures defined through the sole body between the protrusions. The protrusions support the foot. The protrusions may be conical, ribs, or rods. The apertures allow water to drain away from the foot. The apertures extend over the entire length and width of the sole so that water may drain through the sole at any location on the sole.

Another article of footwear incorporating drainage features is disclosed in U.S. patent publication number 2005/0262726 to Ferniani et al. The '726 publication discloses a sandal having an upper, an insole, and a sole. The sole includes a recess with which the insole may be engaged. The sole includes a series of channels for collecting and guiding water to drainage holes formed through the sole. The insole is porous and covers the drainage holes. Water entering the shoe may flow through the insole and into the channels, where the water is directed to the drainage holes.

While there are articles of footwear having water drainage capabilities, there exists a need in the art for features that may improve the drainage of water from the sole.

SUMMARY OF THE INVENTION

An article of footwear includes drainage features to direct water away from the foot of a wearer. The drainage features include drainage holes, which may be substantially vertical channels formed through the sole of the article of footwear. A series of ribs support the foot away from the drainage features, which may be disposed between the ribs.

In one aspect, the invention provides an article of footwear comprising a sole comprising an outsole and an element configured to support a foot away from the outsole; a plurality of ribs formed on the element so that a groove is disposed between at least one set of adjacent ribs; a drainage hole disposed in the groove, wherein the drainage hole is formed at or near a transverse centerpoint of the groove; and wherein each rib includes a raised center portion.

In another aspect, the element has a contoured lower surface configured to direct water to the drainage hole.

In another aspect, the contoured lower surface has a cusp region, wherein the drainage hole is positioned at or near the cusp region.

In another aspect, the contoured lower surface is substantially concave.

In another aspect, an upper is associated with the sole.

In another aspect, the drainage hole is a substantially vertical channel formed through the sole.

In another aspect, the invention provides an article of footwear comprising a sole comprising an outsole and an element configured to support a foot away from the outsole; a plurality of ribs formed on the element so that a groove is disposed between at least one set of adjacent ribs, wherein each rib includes a raised center portion; the element having a contoured lower surface, the contoured lower surface having a cusp region; and a drainage hole disposed in the groove and positioned near the cusp region.

In another aspect, the cusp region is positioned near a transverse centerpoint of the groove.

In another aspect, the cusp region is positioned at a transverse centerpoint of the groove.

In another aspect, the drainage hole is aligned with the raised center portions of the ribs.

In another aspect, an upper is associated with the sole.

In another aspect, the contoured surface is concave.

In another aspect, the drainage hole is a substantially vertical channel formed through the sole.

In another aspect, the invention provides an article of footwear comprising an upper; a sole attached to the upper; an element associated with the sole, the element configured to support a foot away from the sole; a plurality of spaced apart ribs disposed on the element, wherein each rib has a raised center portion; a drainage feature formed through the sole; an inlet to the drainage feature disposed between adjacent ribs.

In another aspect, the drainage feature is a drainage hole.

In another aspect, the drainage hole comprises a vertical channel through the sole.

In another aspect, the ribbed element includes a contoured lower surface configured to direct water to the drainage feature.

In another aspect, the contoured lower surface is concave.

In another aspect, the upper includes a first section and a second section, wherein the first section is removably attachable to the second section.

In another aspect, the upper includes a first layer associated with a second layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
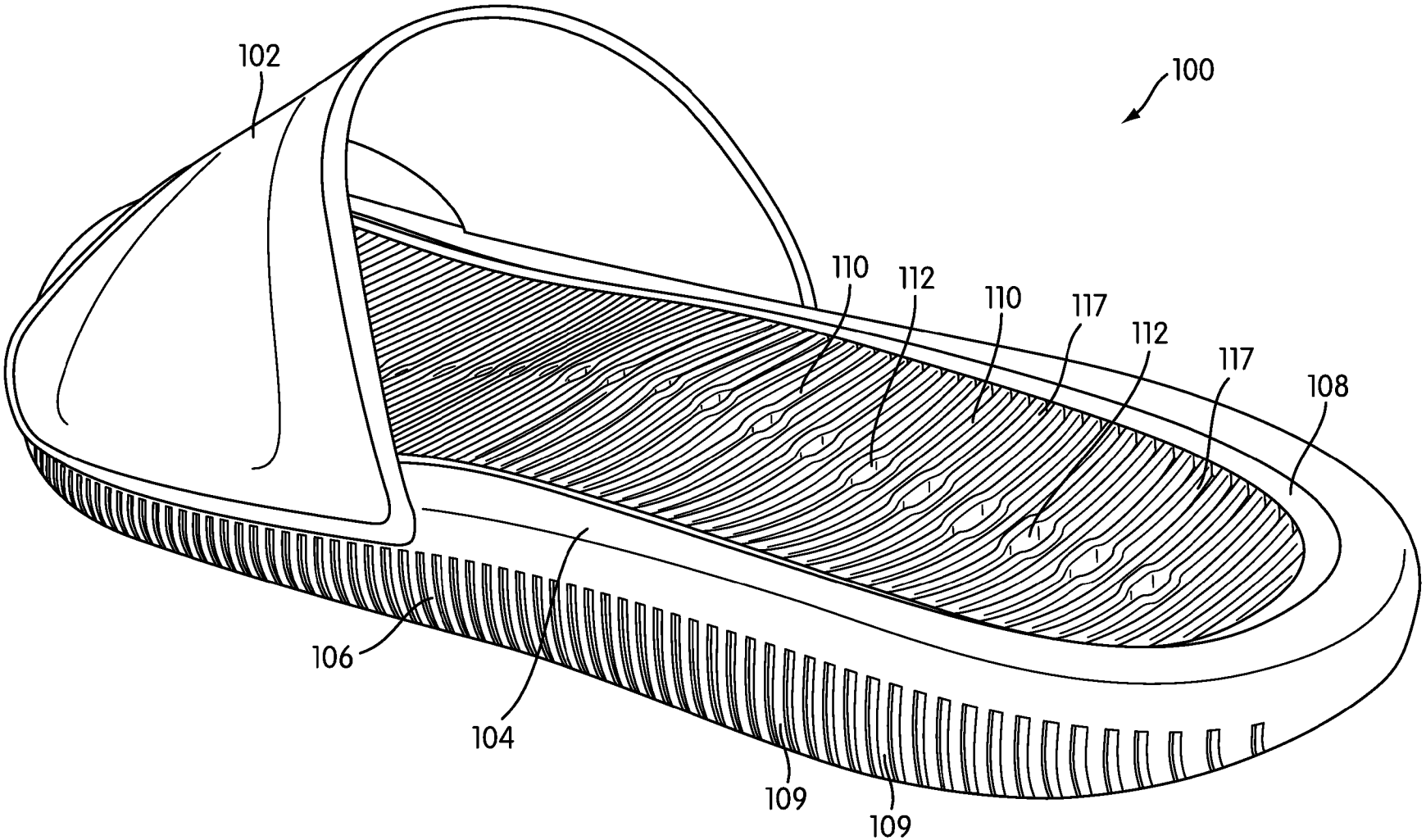
FIG. 1 is a rear perspective view of an embodiment of an article of footwear having drainage features.

An article of footwear is provided with features for draining water to prevent water from accumulating underneath and around the foot of a wearer of the article of footwear. The following discussion and accompanying figures disclose an article of footwear, particularly a sole structure of the footwear. Concepts related to the sole structure are disclosed with reference to footwear having a configuration that is suitable for use in or around water. The sole structure is not limited solely to such footwear, however, and may be utilized with a wide range of footwear styles. An individual skilled in the relevant art will appreciate, therefore, that the concepts disclosed herein apply to a wide variety of footwear styles, in addition to the specific style discussed in the following material and depicted in the accompanying figures.

The figures show an embodiment of an article of footwear 100 provided with drainage features. Only one article of footwear 100 is shown and discussed herein, although a mirror image article of footwear 100 may be provided to form a pair for use by a wearer. Article of footwear 100 generally includes an upper 102 associated with a sole 104.

Upper 102 may be any type of upper known in the art. Upper 102 is depicted as having a substantially conventional configuration incorporating a plurality of material elements (e.g., textiles, foam, leather, and synthetic leather) that are stitched or adhesively bonded together to form an interior void for securely and comfortably receiving a foot. Given that various aspects of the present application primarily relate to sole 104, upper 102 may exhibit the general configuration discussed above or the general configuration of practically any other conventional or non-conventional upper. Accordingly, the structure of upper 102 utilized with sole 104 or variants thereof may vary significantly.

In the embodiment shown in FIGS. 1-4, upper 102 is configured so that a user may slide a foot into upper 102. Upper 102 may extend entirely across sole 104 in a transverse direction and only partially along sole 104 in a longitudinal direction. In other embodiments, upper 102 may have other configurations, such as providing a partition or partitions between the toes, providing straps, or by having upper 102 cover a greater portion of the wearer's foot.

Upper 102 may be made of any material known in the art, but is preferably made of a water-resistant material such as vinyl, plastic, or the like. In some embodiments, upper 102 may be made from a porous material coated or sealed with a water-resistant material.

Upper 102 is preferably associated with sole 104. In some embodiments, upper 102 may be fixedly or removably attached to sole 104. Upper 102 may be associated with sole 104 using any method known in the art, such as by welding, stitching, co-molding, over-molding, joined with an adhesive, or joined with a mechanical fastener. Mechanical fasteners may include a hook-and-loop fastener, snaps, buckles, zippers, or the like. In the embodiment shown in the figures, upper 102 is attached to sole 104 on the periphery of sole 104. In other embodiments, upper 102 may be attached to sole 104 in other locations.

Sole 104 generally includes an outsole 106 that forms the main body of sole 104 and a ribbed element 108 for supporting the wearer's foot. Outsole 106 may be made of any material typically used for ground-engaging surfaces for articles of footwear, such as rubber, silicone, or the like. Outsole 106 may include surface texture or treads 109 for traction between outsole 106 and the ground. Outsole 106 may be made as a single layer or may be made of multiple layers. In one embodiment, outsole 106 may be molded from a single material as a unitary element. In other embodiments, outsole 106 may include multiple layers associated with each other using any method known in the art, such as with an adhesive, by welding, or the like.

To enhance drainage, article of footwear 100 may include provisions that lift a wearer's foot away from outsole 106. In some embodiments, these provisions may include ribs or protrusions that extend away from outsole 106. As shown in FIGS. 1-4, article of footwear 100 is provided with a plurality of ribs 110. Ribs 110 extend away from outsole 106 so that the wearer's foot rests on ribs 110 and is supported away from outsole 106. In some embodiments, ribs 110 may be spaced apart elongated elements. In some embodiments, ribs 110 may be parallel to each other and spaced apart to form grooves 117 between adjacent ribs 110. Grooves 117 may be uniform in size along the length and width of sole 104, or grooves 117 may have different sizes, such as if ribs 110 are not evenly spaced apart or if a single groove 117 may have wider and narrower portions.

In other embodiments, other provisions may be used to support a wearer's foot away from outsole 106, such as other types of protrusions, a net or net-like structure stretched across article of footwear 100 so that the wearer's foot is suspended over outsole 106, or any other type of element that may be used to support the wearer's foot away from outsole 106.

In some embodiments, ribs 110 may be formed as part of a ribbed element 108. Ribbed element 108 may be a unitary element that extends at least partially along the length of outsole 106. In some embodiments, ribbed element 108 may be substantially co-extensive with outsole 106, as shown in FIGS. 1-4 and 7. In other embodiments, ribbed element 108 may extend only along a portion of outsole 106. Ribbed element 108 may be formed separately from outsole 106 and associated with outsole 106 using any method known in the art, such as by over-molding or with an adhesive. Examples of various types of adhesives that could be used include, but are not limited to natural adhesives, synthetic adhesives, drying adhesives, contact adhesives, hot melt adhesives (such as thermoplastic adhesives) and pressure sensitive adhesives.

In some embodiments, ribbed element 108 may be made from the same material as outsole 106. In such embodiments, ribbed element 108 may be co-formed with outsole 106. In other embodiments, ribbed element 108 may be formed from a different material than outsole 106. In some embodiments, ribbed element 108 may be made from a stiffer material than outsole 106 so that ribs 110 resist bending when a wearer's foot applied pressure to ribs 110. In some embodiments, ribbed element 108 may be made from a plurality of materials, such as a relatively stiff material coated or covered with a softer material. In these embodiments, ribs 110 resist bending due to the stiff inner material while the foot of the wearer is cushioned against the softer outer material.

Figure 5:
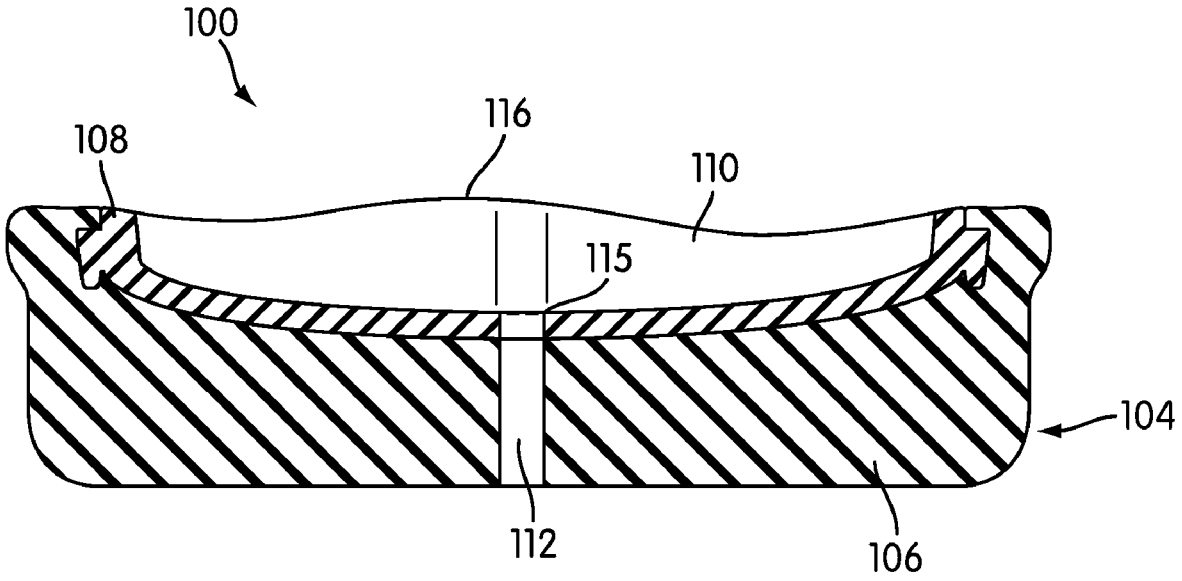
FIG. 5 is a cross-sectional view of the article of footwear shown in FIG. 2.

In some embodiments, sole 104 may include provisions that may move fluid away from a wearer's foot. In some embodiments, sole 104 may be provided with drainage features and other features that enhance the drainage capabilities of sole 104. In one embodiment, the drainage features include drainage holes 112. Drainage holes 112 may be openings formed entirely through sole 104, through both outsole 106 and ribbed element 108. In some embodiments, drainage holes 112 form a relatively straight flow path through sole 104. In some embodiments, as shown in FIG. 5, drainage holes 112 may be substantially straight vertical channels formed through sole 104.

Drainage holes 112 may have any cross-sectional shape known in the art, such as circular, elliptical, polygonal, or the like. In some embodiments, the cross-sectional shape of drainage holes 112 does not include corners or other sharp angles in order to resist the accumulation of water or debris. Drainage holes 112 may have any desired size. In the embodiment shown in the figures, for example, drainage holes 112 may have different sizes. In other embodiments, all drainage holes 112 may be the same size or similarly sized.

In some embodiments, drainage holes 112 may be used to evacuate fluid from article of footwear 100. In some embodiments, drainage holes 112 may be used to evacuate fluid that may accumulate near a wearer's foot toward outsole 106, through outsole 106, or away from outsole 106. Drainage holes 112 may be positioned along sole 104 anywhere that fluid may accumulate. Any number of drainage holes 112 may be provided, such as a single hole or multiple holes.

Figure 2:
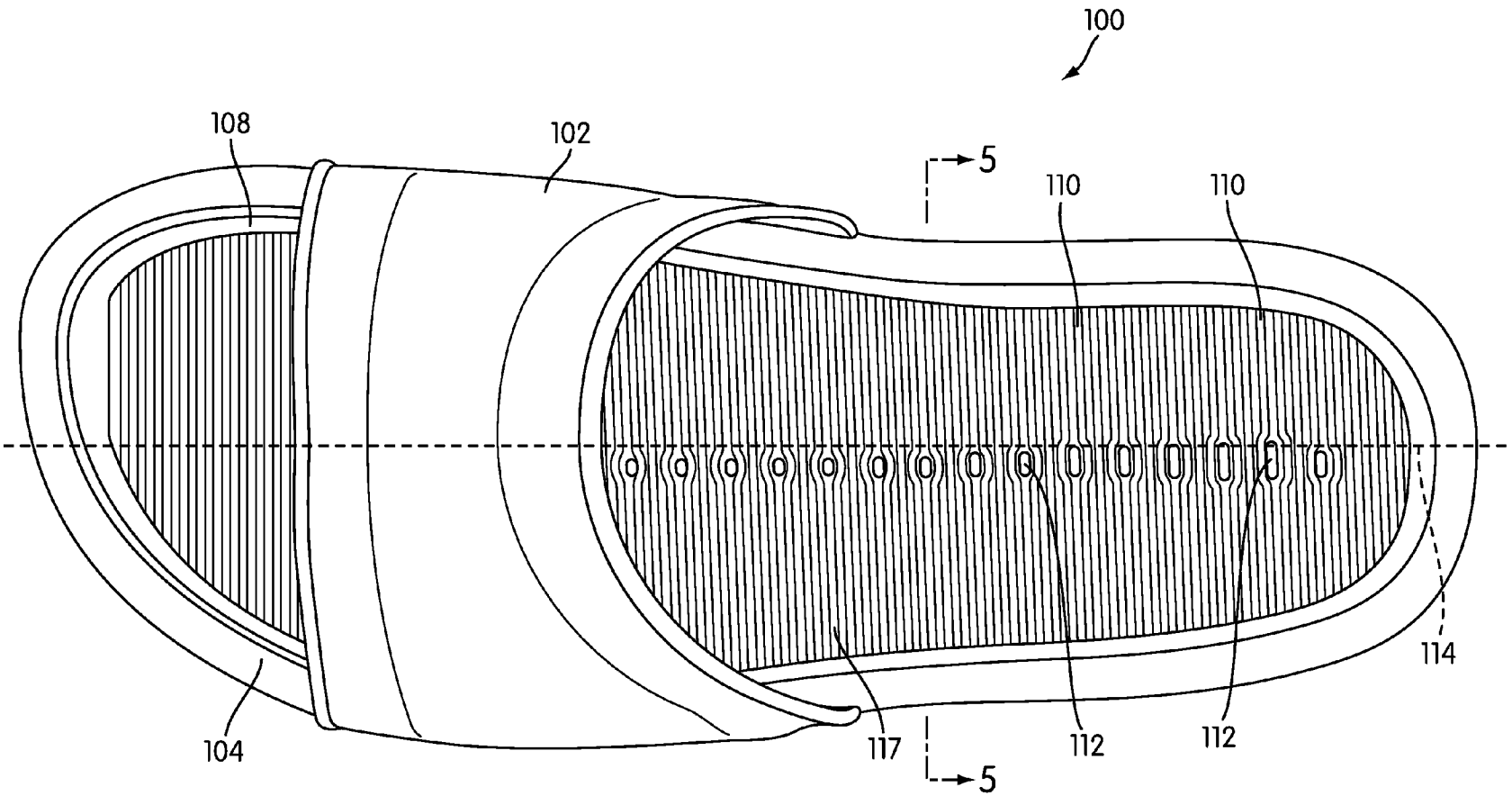
FIG. 2 is a top plan view of an embodiment of an article of footwear having drainage features.
Figure 3:
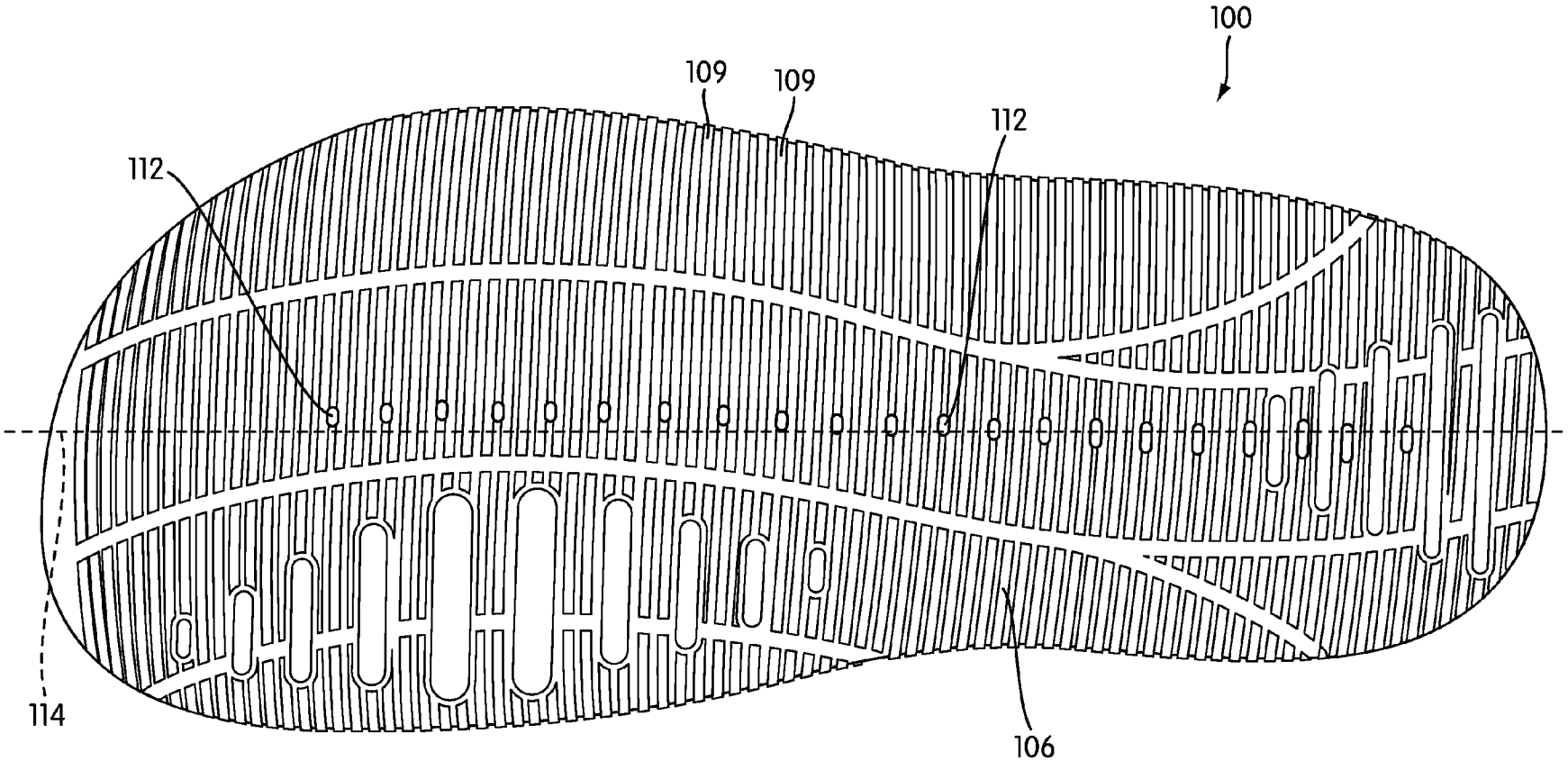
FIG. 3 is a bottom plan view of an embodiment of an article of footwear having drainage features.

In one embodiment, such as the embodiment shown in the figures, drainage holes 112 may be positioned in a groove 117 between at least one set of adjacent ribs 110. In some embodiments, each groove 117 may include at least one drainage hole 112. In other embodiments, only select grooves 117 may include at least one drainage hole 112. In the embodiment shown in the figures, only a single drainage hole 112 is placed in any groove 117 and only select grooves 117 contain drainage holes 112. In other embodiments, multiple drainage holes 112 may be placed in a single groove 117. As best shown in FIGS. 2 and 3, in some embodiments, drainage holes 112 may be positioned generally along a centerline 114 of article of footwear 100.

Figure 8:
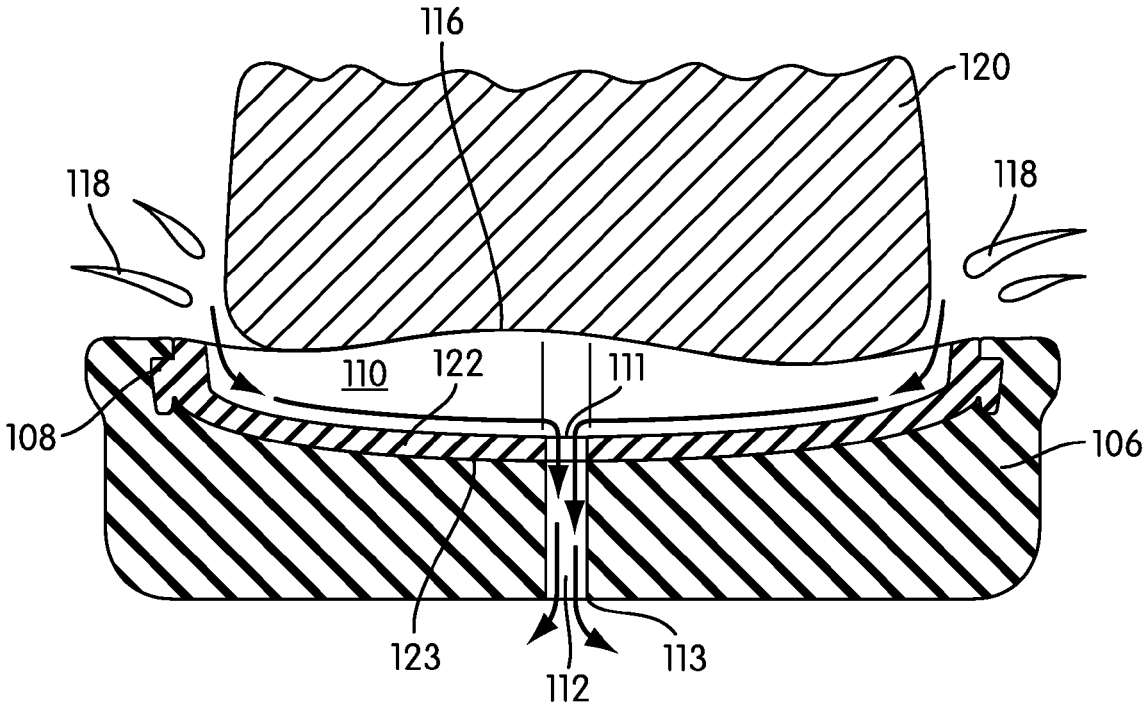
FIG. 8 is a cross-sectional view of the article of footwear shown in FIG. 6 showing the flow of water through the article of footwear.

As shown in FIG. 8, a lower surface 122 of ribbed element 108 and an upper surface 123 of outsole 106 may be contoured to control the flow of fluid. This contouring may be generally concave, with the lowest point or cusp or region containing the lowest point or cusp region of the contouring being established at or near the transverse centerpoint 115 of sole 104. In other embodiments, the contouring may have its lowest point or cusp region containing the lowest point or cusp region at other positions on sole 104, such as on a lateral and/or medial side of sole 104, in a toe region of sole 104, in a heel region of sole 104. In other embodiments, the contouring may have multiple low points, so that fluid may be directed towards a number of different spots on sole 104. The contouring may be smooth, as shown in the figures, to form a bowl or cup-like cross-sectional shape. In other embodiments, however, the contouring may have other cross-sectional shapes, such as stepped, parabolic, frustoconical, wavy, or combinations of these shapes.

By positioning drainage holes 112 generally along centerline 114, water may flow along the contour of lower surface 122 of ribbed element 108 so that the water is directed to drainage holes 112. This enhances the ability of water to drain from sole 104 and away from the foot of the wearer.

Additionally, ribs 110 may include provisions that further enhance drainage capabilities of article of footwear 100. In some embodiments, ribs 110 may include provisions that lift portions of the wearer's foot further away from outsole 106 than other portions of the wearer's foot. In some embodiments, ribs 110 may be contoured. In some embodiments, ribs 110 may be contoured to include raised portions. The raised portion may be positioned at any point along rib 110. In some embodiments, the raised portion may be positioned to correspond to the location of a drainage hole 112.

Figure 4:
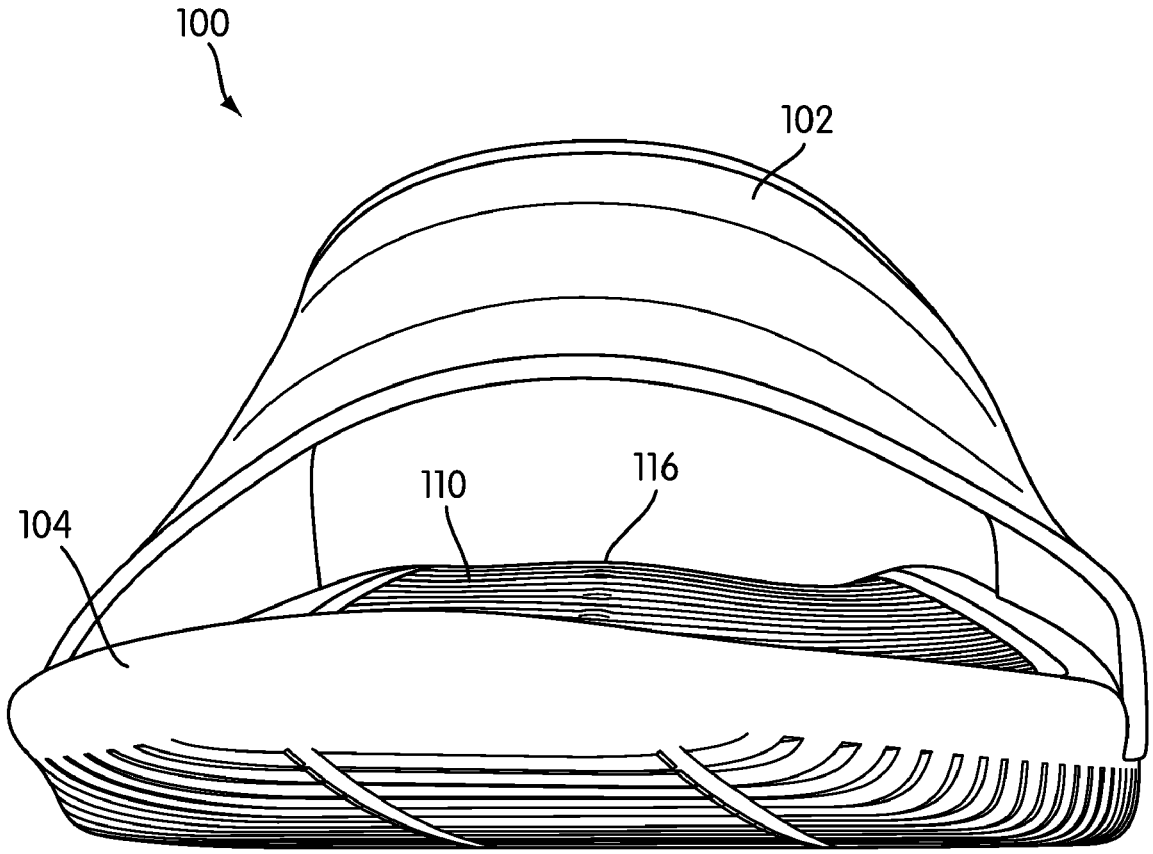
FIG. 4 is a front view of an embodiment of an article of footwear having drainage features.

In the embodiment shown in the figures, as best seen in FIGS. 4, 5, and 8, ribs 110 are contoured so that each rib 110 includes a raised center portion 116. The raised center portions 116 of ribs 110 are generally positioned to follow centerline 114. Therefore, as best shown in FIGS. 5 and 8, each drainage hole 112 is positioned substantially beneath the raised center portion 116 of a rib 110. Raised center portion 116 is configured to lift and support the foot of the wearer further away from lower surface 122 of ribbed element 108 in the vicinity of drainage hole 112. Lifting the foot of the wearer away from lower surface 122 enhances the ability of the water to flow underneath the foot and to drainage holes 112.

In some embodiments, ribs 110 may also include provisions to control the spacing between adjacent ribs 110. In some embodiments, ribs 110 may be contoured to widen the interstitial spacing between two adjacent ribs 110 in discrete locations along the length of ribs 110. For example, ribs 110 that surround drainage holes 112 may be contoured to widen groove 117 in the vicinity of drainage holes 112 to enhance the ability of the drainage holes 112 to direct water away from the foot of the wearer. Such contouring may be particularly advantageous when drainage holes 112 of multiple sizes or large drainage holes 112 are used. Contouring of ribs 110 accommodates larger drainage holes 112 without increasing the overall interstitial spacing between adjacent ribs 110. If ribs 110 are spaced too far apart, the wearer's foot may be uncomfortable.

Additionally, for comfort, ribs 110 may not all have the same height. In some embodiments, all ribs 110 may extend the same distance away from sole 104. If ribs 110 include contouring as described above, all ribs 110 may have the same contouring. However, in other embodiments, some ribs 110 may extend a different distance away from sole 104 than other ribs 110. For example, ribs 110 positioned in a forefoot portion of article of footwear 100 may extend, generally, further away from sole 104 than do ribs 110 in an arch region of article of footwear 100. Similarly, ribs 110 in a heel region of article of footwear 100 may extend further away from sole 104 than do ribs 110 positioned in an arch region of article of footwear 100. In some embodiments, ribs 110 positioned in the forefoot and heel regions may extend away from sole 104 the same or a similar distance.

Figure 10:
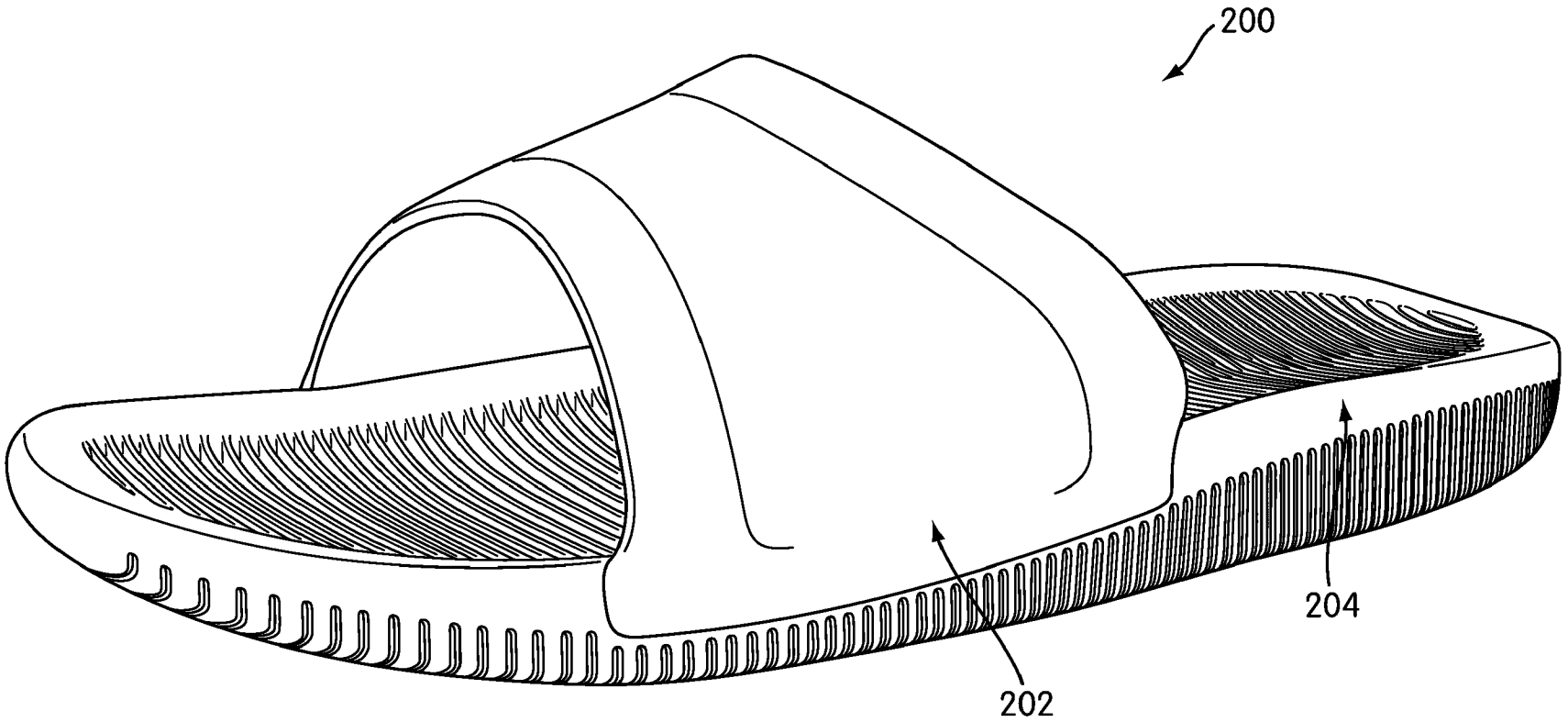
FIG. 10 a perspective view of an embodiment of an article of footwear having drainage features and a one-piece sole.
Figure 11:
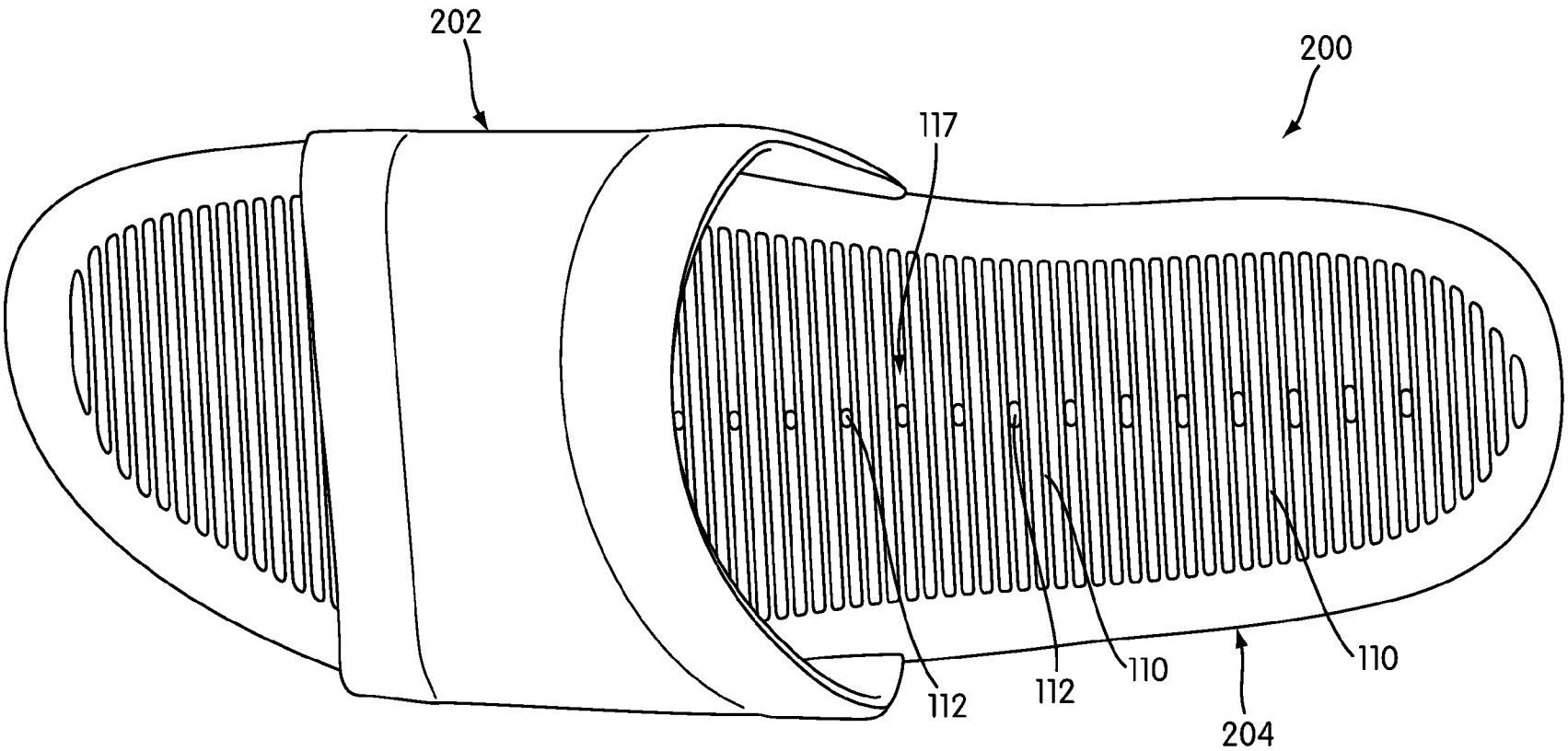
FIG. 11 is a top plan view of an embodiment of an article of footwear having drainage features and a one-piece sole.

This increased height of ribs 110 in the forefoot and heel regions provide additional massaging effects to the wearer's foot in these regions. When the wearer is standing or walking, the weight of the wearer tends to be on the heel or the forefoot and not, generally, in the center of the foot. Having higher ribs 110 in the forefoot and heel regions, therefore, may be more comfortable for a wearer. Additionally, if ribs 110 are integrally formed with sole 104, as is shown in FIGS. 10-11 and discussed in greater detail below, the manufacturing process for a single-injection molded sole may be improved by having ribs 110 of varying height. Ribs 110 in the center of the mold (i.e., ribs 110 positioned in the arch region) may be more difficult to manufacture consistently at longer lengths. Shortening ribs 110 in this portion of article of footwear 100 may yield more consistent manufacturing results during a manufacturing run.

Figure 6:
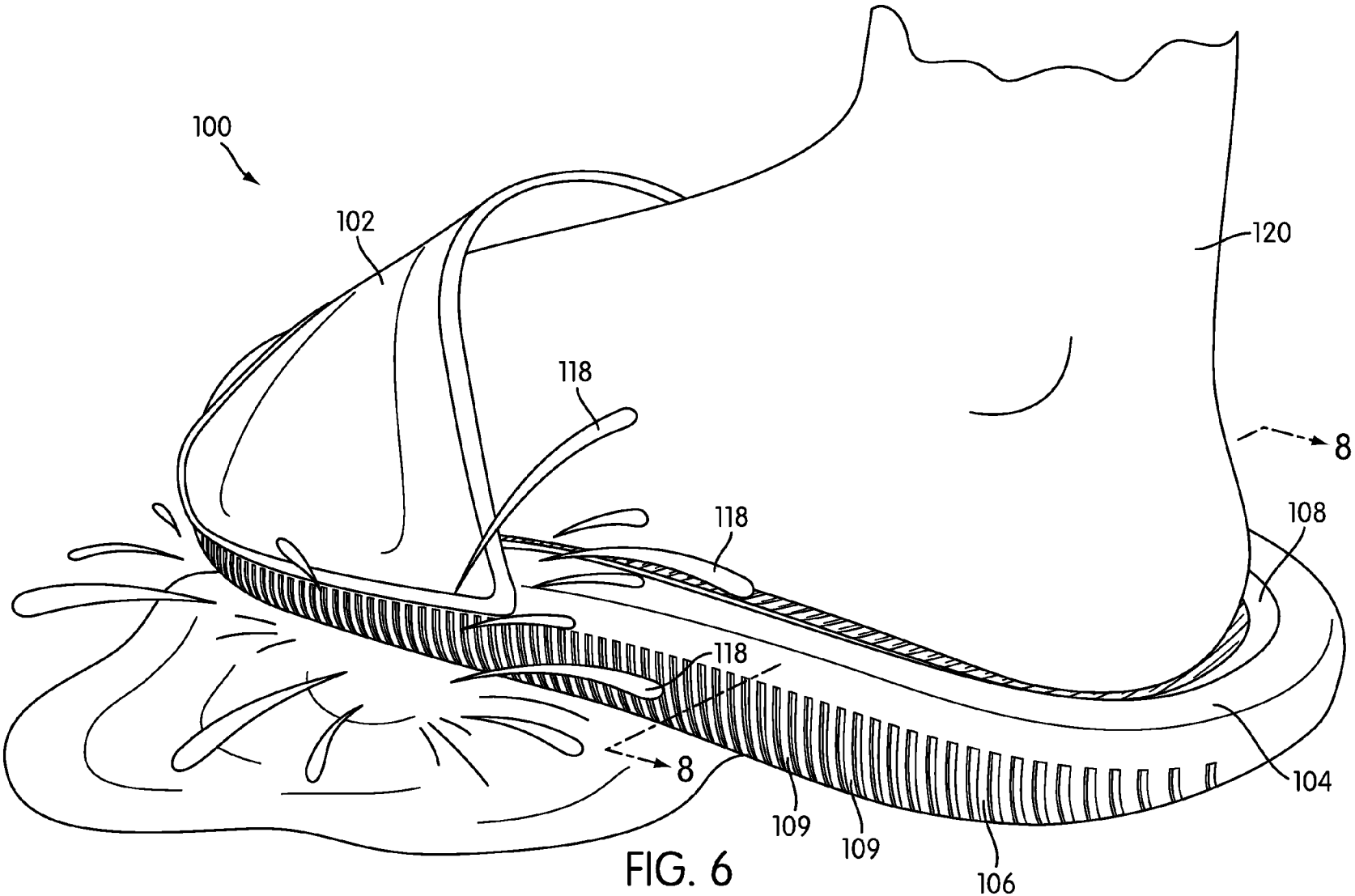
FIG. 6 is a perspective view of an embodiment of an article of footwear having drainage capabilities as worn by a user in water.
Figure 7:
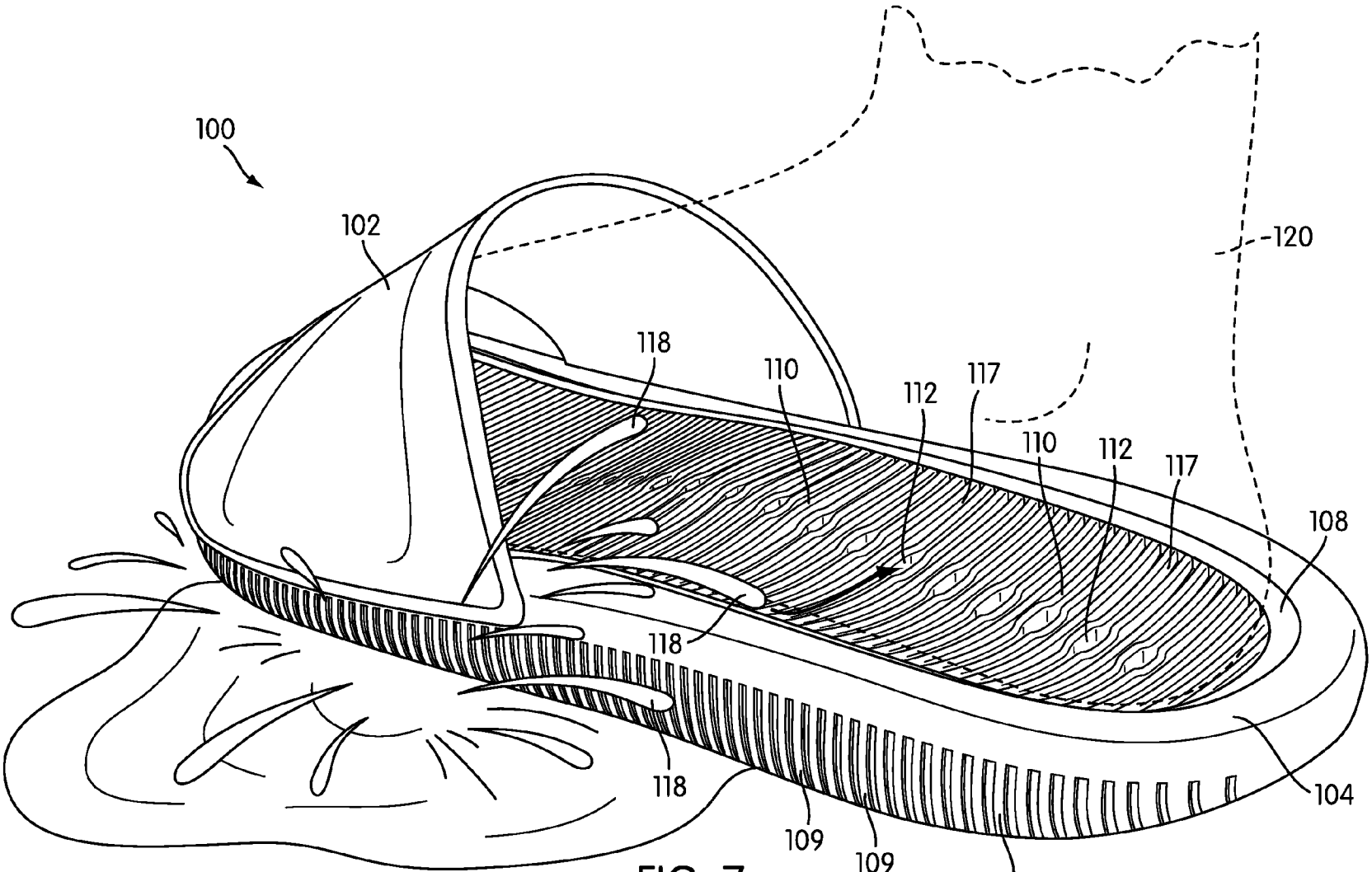
FIG. 7 is a perspective view of the article of footwear shown in FIG. 6 with the user's foot shown in phantom.

FIGS. 6-8 show how one embodiment of article of footwear 100 may be used to move fluid away from a wearer's foot and to evacuate fluid from article of footwear 100. FIG. 6 shows a foot 120 positioned in article of footwear 100. Article of footwear 100 is exposed to water 118. In the example shown in FIG. 6, water 118 is being splashed into article of footwear 100. In other embodiments, article of footwear 100 may be exposed to water 118 in other ways, such as raining or showering water 118 down onto article of footwear 100, submerging article of footwear 100, or the like. Water 118 flows into article of footwear 100, as is indicated by the arrow in FIG. 7, which is the same as FIG. 6 with foot 120 shown in phantom for clarity. Water 118 may accumulate in grooves 117. Water 118 may reach a sufficient depth that water 118 may temporarily accumulate around foot 120 prior to evacuation.

FIG. 8 is a cross-sectional view of FIG. 6 that shows the flow pattern of water 118 through article of footwear 100. Water 118 generally enters article of footwear 100 along a periphery of foot 120. Foot 120 is supported away from lower surface 112 of ribbed element 108 by rib 110. In particular, foot 120 is held furthest away from lower surface 122 by raised center portion 116 of rib 110. Due to the action of gravity and/or to movement of article of footwear 100, water 118 flows along the contour of lower surface 122, as indicated by the arrows, and is directed towards drainage hole 112. Water 118 enters drainage hole 112 through hole inlet 111, which may be formed in ribbed element 108. Water 118 flows through or accumulates in drainage hole 112. Some water 118 may exit drainage hole 112 via hole outlet 113, which may be formed in outsole 106. Water 118 may then flow away from article of footwear 100.

In some embodiments, the depth of grooves 117 and drainage holes 112 may be sufficient to keep water 118 from maintaining contact with foot 120 for extended periods. In some embodiments, therefore, water 118 need not exit drainage hole 112 via hole outlet 113, or hole outlet 113 may not be provided. Rather, a wearer may remove article of footwear 100 from foot 120 and invert article of footwear 100 to pour any accumulated water 118 out of grooves 117 and/or drainage holes 112.

Figure 9:
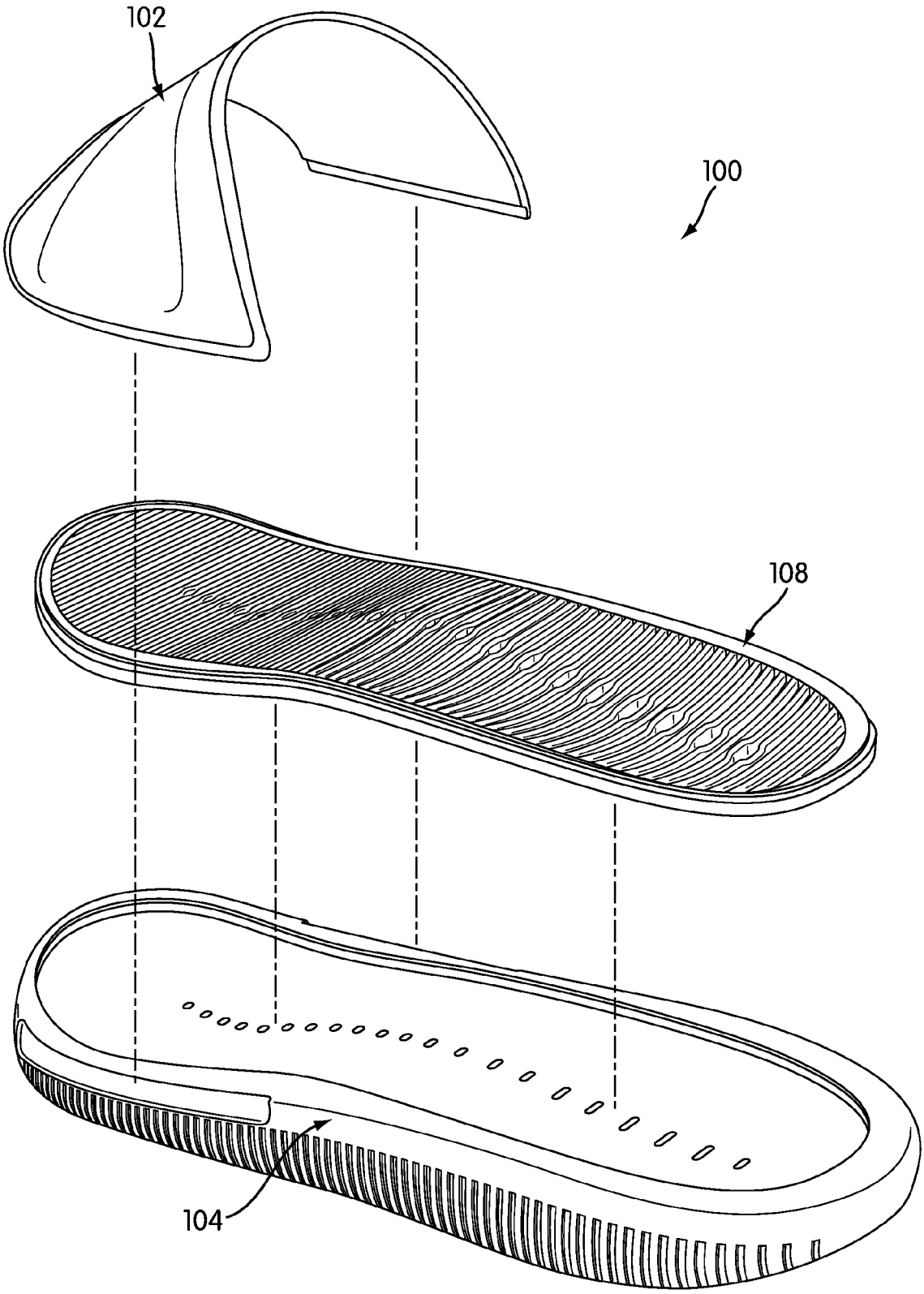
FIG. 9 is an exploded view of an embodiment of an article of footwear having drainage features.

In some embodiments, article of footwear 100 may be configured to be completely disassembled, such as to be able to clean and/or disinfect the individual elements of article of footwear 100. As shown in FIG. 9, upper 102 and ribbed element 108 may be separated from sole 104. In a separable configuration, upper 102 and/or ribbed element 108 may be removably attached to sole 104 using any method known in the art, such as press-fitting upper 102 into grooves provided on sole 104, with other fasteners such as hook-and-loop fasteners, or the line. In other embodiments, upper 102 and/or ribbed element 108 may be fixedly attached to sole 104, such as by stitching, with an adhesive, or using any other method or fastening system known in the art.

FIGS. 10-11 show another embodiment of an article of footwear 200 having drainage features. Article of footwear 200 is similar to article of footwear 100, in that article of footwear 200 includes an upper 202 associated with a sole 204, where sole 204 includes drainage features. The drainage features, as shown in FIG. 11, include a plurality of ribs 110 disposed along a length of sole 204. In this embodiment, drainage holes 112 are formed through sole 204 in the interstitial spaces 117 between adjacent ribs 110. The drainage holes 112 are disposed at or near the transverse centerpoint of sole 204.

In this embodiment, ribs 110 are not formed on a separate ribbed element. Instead, ribs 110 are integrally formed with sole 204 so that ribs and sole 204 are a single, unitary portion of material. Such an embodiment may be provided to reduce costs or to minimize the collection points of water in article of footwear 200.

Because sole 204 is formed as a unitary portion of material in this embodiment, the materials used to form sole 204 may differ from the materials used in other embodiments. If cost reduction is a motive in making a unitary sole, the material or materials used for sole 204 may be lower in cost than in other embodiments. Also, because various features are included on sole 204, a lower weight material may be used for sole 204 so that the weight of sole 204 does not become uncomfortable for the wearer. Finally, because many features may be included in sole 204, the material or materials chosen for sole 204 may be selected for ease and/or consistency in manufacturing all of the features of sole 204, including, for example, ribs 110 and drainage holes 112. In unitary-body sole embodiments, sole 204 may be injection molded with thermoplastic polyurethane (TPU). In other embodiments, sole 204 may be made from other materials and/or formed using other manufacturing methods known in the art.

Figure 12:
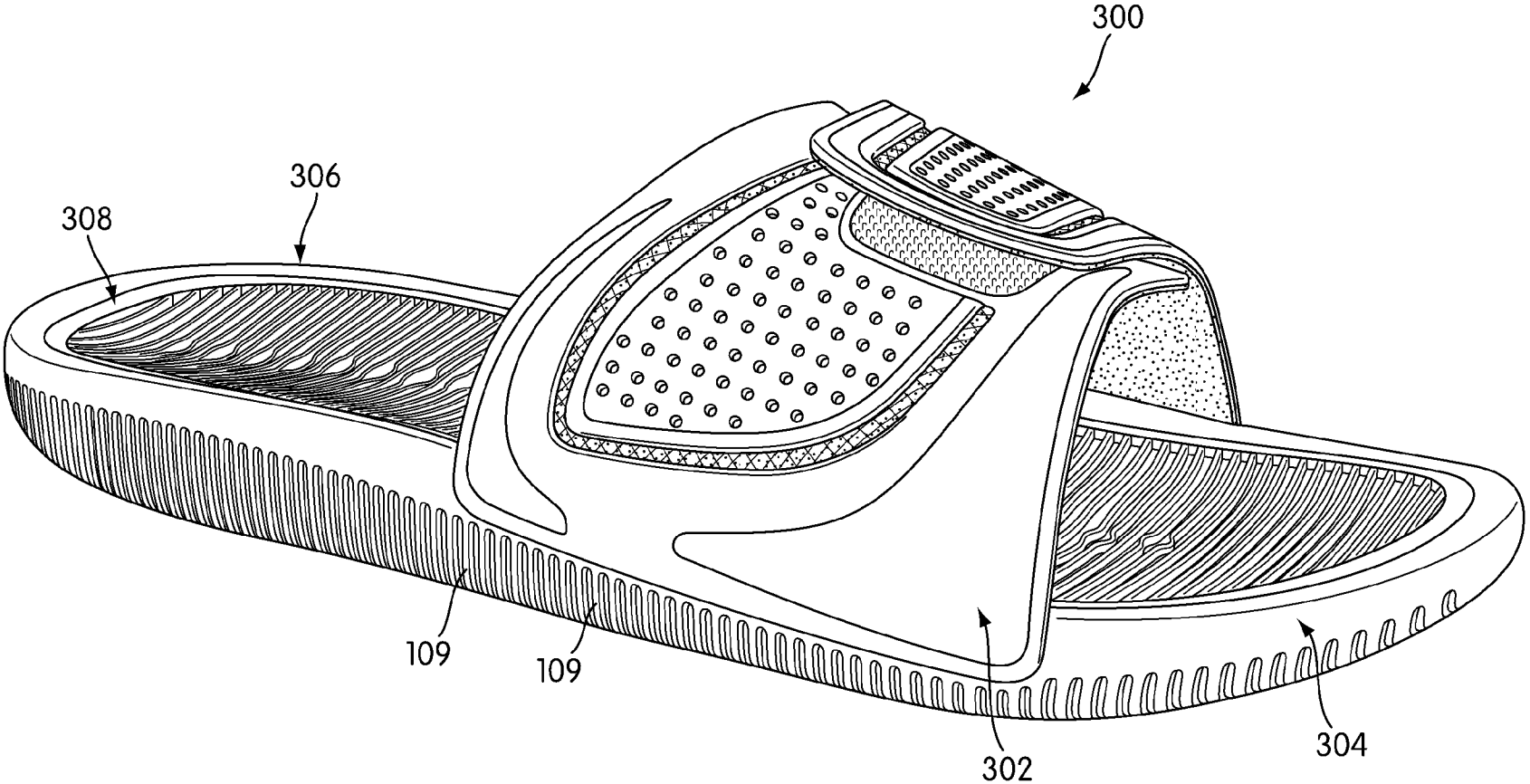
FIG. 12 is a perspective view of an embodiment of an article of footwear having drainage features and an alternate upper configuration.
Figure 13:
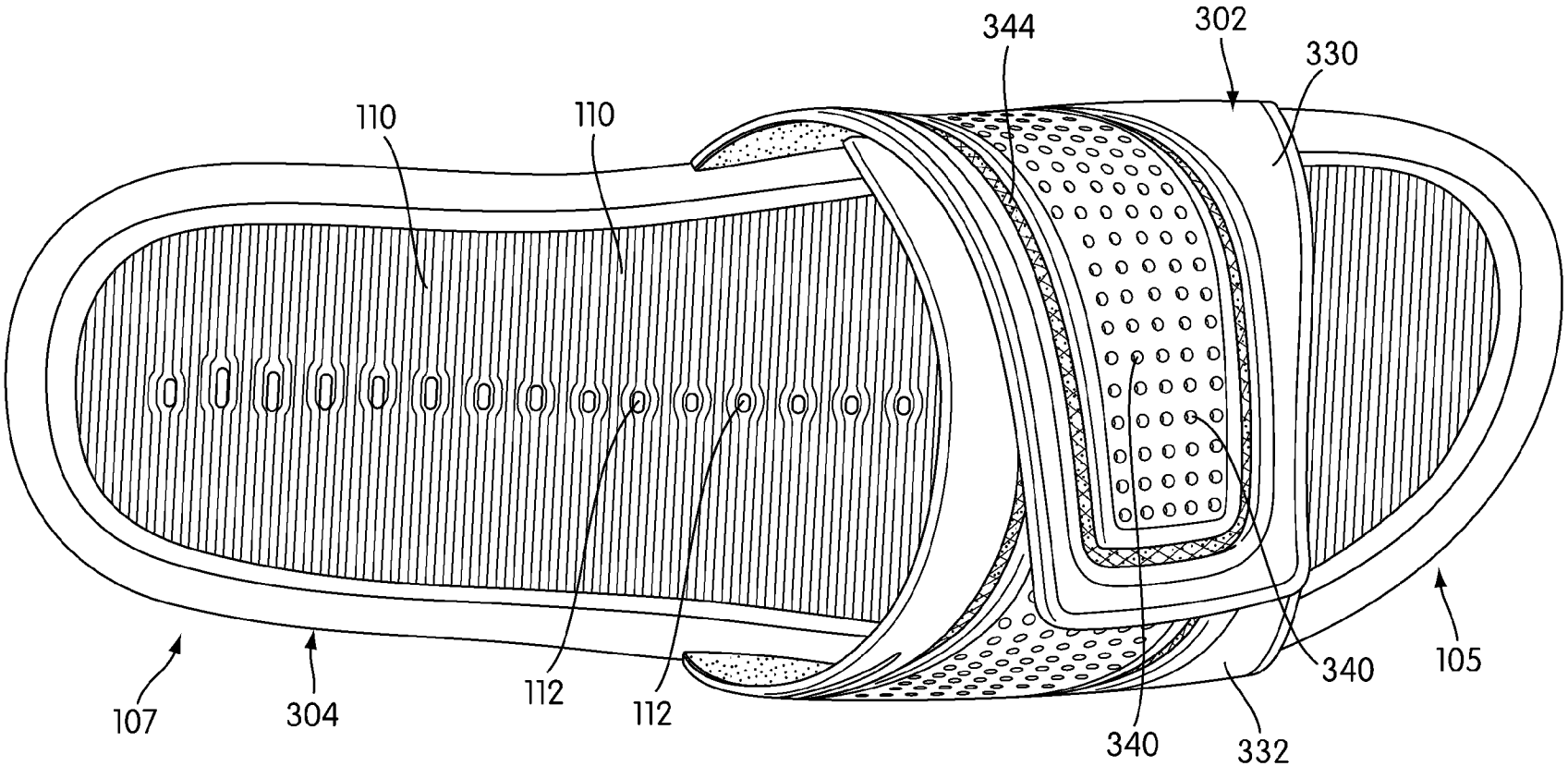
FIG. 13 is a top plan view of the article of footwear shown in FIG. 12 with the upper in a closed configuration.
Figure 14:
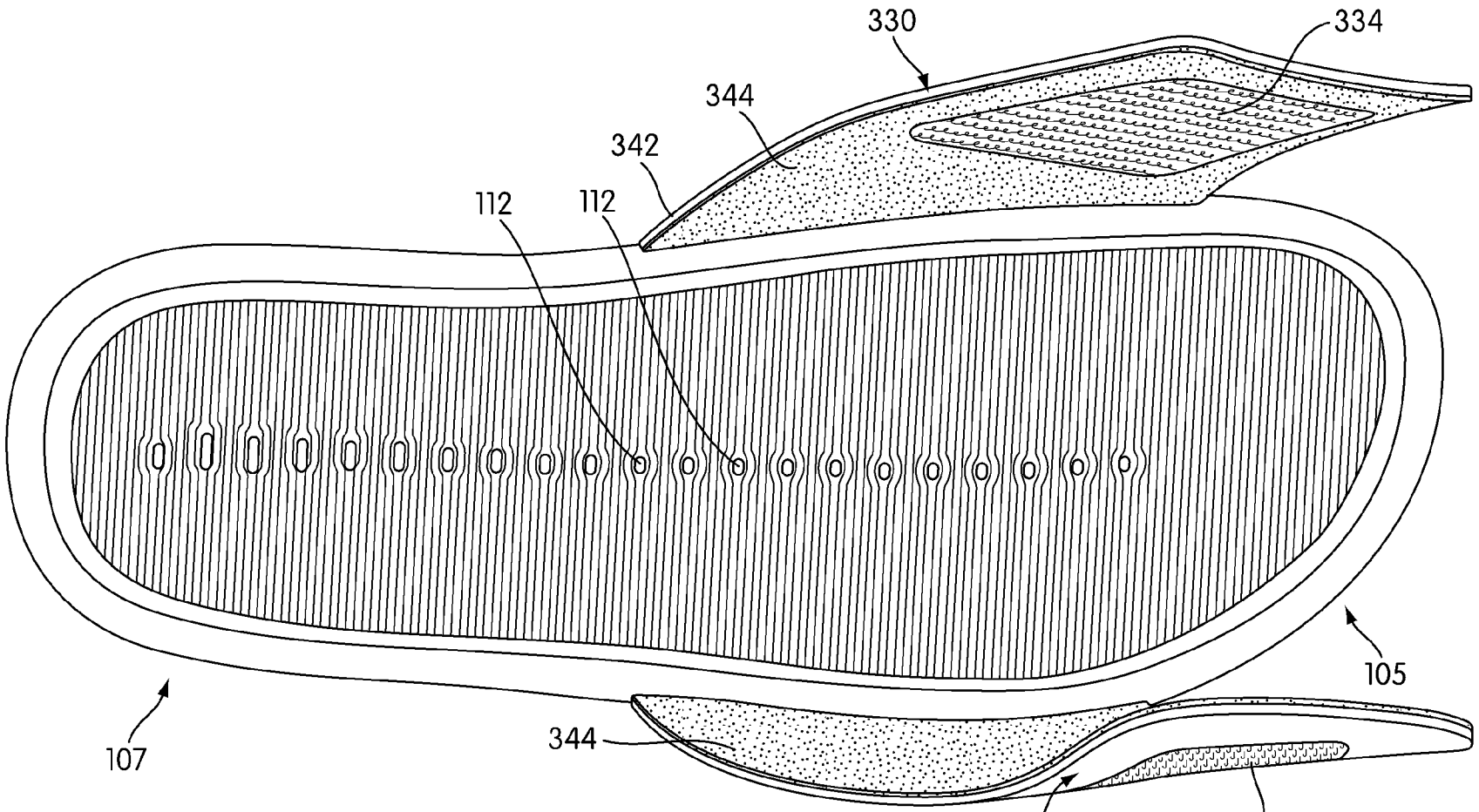
FIG. 14 is a top plan view of the article of footwear shown in FIG. 12 with the upper in an open configuration.

FIGS. 12-14 show another embodiment of an article of footwear 300 having drainage features. Article of footwear 200 is similar to articles of footwear 100 and 200, in that article of footwear 300 includes an upper 302 associated with a sole 304, where sole 304 includes drainage features. The drainage features, as shown in FIGS. 13 and 14, include a plurality of ribs 110 disposed along a length of sole 304. In this embodiment, drainage holes 112 are formed through sole 304 in the interstitial spaces 117 between adjacent ribs 110. The drainage holes 112 are disposed at or near the transverse centerpoint of sole 304.

In addition to drainage features in sole 304, upper 302 has also been provided with drainage features in this embodiment. As shown in FIGS. 13 and 14, upper 302 is split into two sections: a first section 330 and a second section 332. First section 330 and second section 332 are configured to be removably attached to each other. This is done so that first section 330 and second section 332 may be separated, as shown in FIG. 14. This open configuration of upper 302 may allow article of footwear 300 to dry faster than a similar article of footwear with an upper that does not open.

First section 330 and second section 332 may be removably attached to each other using any method known in the art. In the embodiment shown in the figures, first section 330 is provided with a first portion 334 of a hook-and-loop fastener while second section 332 is provided with a second portion 336 of the hook-and-loop fastener configured to engage with first portion 334. In the embodiment shown in the figures, first portion 334 is fixedly attached to an underside of first section 330 while second portion 336 is fixedly attached to an upper surface of second section 332. When attached to each other, therefore, first section overlaps second section 332. In other embodiments, first section 330 may be attachable to second section 332 so that little or no overlap occurs, for example, if the edges of first section 330 and second section 332 are provided with zipper teeth. In other embodiments, any type of mechanical or other type of fastener may be used, such as snaps, buttons, zippers, press-fitting elements, or magnets.

In addition to allowing for a faster drying time, upper 302 is also size adjustable. As shown in FIGS. 12 and 13, the two sections of upper 302 may be attached to each other with different amounts of overlap. Therefore, upper 302 may be adjusted to be tighter (with more overlap) or looser (with less overlap) on the wearer's foot. In addition to being able to fit a number of different users, this adjustability may also be used by a single user to accommodate different uses. For example, a wearer may find article of footwear 300 more comfortable to wear while wet if upper 302 is looser. Alternatively, a wearer may find article of footwear 300 more comfortable and secure to wear while wet if upper 302 is fitted more tightly to the foot. Having an adjustable upper such as upper 302 allows a user to select the tightness of the fit according to his or her preference.

Upper 302 may be provided with additional drainage features. Upper 302 as shown in the figures is a multi-layer upper. A first layer 344 is associated with a second layer 342 using any method known in the art, such as by stitching or with an adhesive. First layer 344 may be configured to contact the wearer's foot while second layer 342 may be configured to form the exterior surface of upper 302. In some embodiments, first layer 344 may be made from a porous material so that water or other fluids may be transferred rapidly through first layer 344. For example, first layer 344 may be made from a mesh material.

Second layer 342 may be made of a nonporous, water resistant, or even waterproof material. Second layer 342 may be made of such a material to increase the durability of upper 302. Such materials may include plastics, vinyl, natural or synthetic rubber, or similar flexible but durable materials. Second layer 342 may be configured with apertures 340 in the form of holes or linear grooves configured to expose portions of first layer 344. Apertures 340 may enhance the ability of water to enter or exit upper 302 for comfort and/or ease of drying.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

a sole comprising an outsole and an element configured to support a foot away from the outsole;

a plurality of ribs formed on the element so that a groove is disposed between at least one set of adjacent ribs;

a drainage hole disposed in the groove, wherein the drainage hole is formed at or near a transverse centerpoint of the groove;

wherein the at least one set of adjacent ribs are contoured to widen the groove in an area corresponding to the drainage hole; and wherein each rib includes a raised center portion.

2. The article of footwear according to claim 1, wherein the element has a contoured lower surface configured to direct water to the drainage hole.

3. The article of footwear according to claim 2, wherein the contoured lower surface has a cusp region, and wherein the drainage hole is positioned at or near the cusp region.

4. The article of footwear according to claim 2, wherein the contoured lower surface is substantially concave.

5. The article of footwear according to claim 1 further comprising an upper associated with the sole.

6. The article of footwear according to claim 1, wherein the drainage hole is a substantially vertical channel formed through the sole.

7. An article of footwear comprising:

a sole comprising an outsole and an element configured to support a foot away from the outsole;

a plurality of ribs formed on the element so that a groove is disposed between at least one set of adjacent ribs, wherein each rib includes a raised center portion;

the element having a contoured lower surface, the contoured lower surface having a cusp region;

a drainage hole disposed in the groove and positioned near the cusp region; and wherein the at least one set of adjacent ribs are contoured to widen the groove in an area corresponding to the drainage hole.

8. The article of footwear of claim 7, wherein the plurality of ribs are formed on the element in a midfoot section and a heel section of the article.

9. The article of footwear of claim 7, wherein the cusp region is positioned at a transverse centerpoint of the groove.

10. The article of footwear of claim 7, wherein the plurality of ribs are substantially co-extensive with the outsole.

11. The article of footwear according to claim 10 further comprising an upper associated with the sole.

12. The article of footwear according to claim 7, wherein the contoured lower surface is concave.

13. The article of footwear according to claim 7, wherein the drainage hole is a substantially vertical channel formed through the sole.

14. An article of footwear comprising:

an upper;

a sole attached to the upper;

an element associated with the sole, the element configured to support a foot away from the sole;

a plurality of spaced apart ribs disposed on the element, wherein each rib has a raised center portion;

a drainage feature formed through the sole;

an inlet to the drainage feature disposed between adjacent ribs; and wherein the plurality of spaced apart ribs are contoured to widen the inlet in an area corresponding to the drainage feature.

15. The article of footwear of claim 14, wherein the drainage feature is proximately aligned with a centerline of the article in a midfoot section and a heel section of the article.

16. The article of footwear of claim 14, wherein the drainage feature comprises a plurality of drainage holes.

17. The article of footwear of claim 14, wherein the element includes a contoured lower surface configured to direct water to the drainage feature.

18. The article of footwear of claim 16, wherein the plurality of drainage holes increase in size from a midfoot section to a heel section of the article.

19. The article of footwear of claim 14, wherein the upper includes a first section and a second section, wherein the first section is removably attachable to the second section.

20. The article of footwear of claim 14, wherein the upper includes a first layer associated with a second layer.

* * * * *